United States Patent [19]

Hundt

[11] Patent Number: 4,930,648

[45] Date of Patent: Jun. 5, 1990

[54] TRIPLE SEAL MOLDED OUTLET FOR PLASTIC STORAGE CONTAINER

[75] Inventor: Gary W. Hundt, Fort Worth, Tex.

[73] Assignee: Essex Environmental Industries, Inc., Hurst, Tex.

[21] Appl. No.: 363,503

[22] Filed: Jun. 8, 1989

[51] Int. Cl.[5] ..... B65D 90/00

[52] U.S. Cl. ..... 220/1 B; 220/1.5; 220/288; 220/DIG. 6

[58] Field of Search ..... 220/1 B, 18, 1.5, 3, 220/83, 288, 465, DIG. 6

[56] References Cited

U.S. PATENT DOCUMENTS

| | | | |
|---|---|---|---|
| 1,343,169 | 6/1920 | Douglass | 220/465 |
| 2,711,841 | 6/1955 | Schaefer et al. | 220/465 |
| 4,560,232 | 12/1985 | O'Hara | 220/3 |
| 4,595,112 | 6/1986 | Dubois | 220/465 |
| 4,602,480 | 7/1986 | Hill et al. | 220/3 |
| 4,793,491 | 12/1988 | Wolf et al. | 220/3 |

*Primary Examiner*—Jimmy G. Foster

*Attorney, Agent, or Firm*—Davis Hoxie Faithfull & Hapgood

[57] ABSTRACT

A triple sealing outlet for use in plastic containers comprises a first cylindrical surface, preferably threaded, extending from an outer wall of the container; a flat, annular surface perpendicular to the first surface and lying within the wall; and a second cylindrical surface of smaller diameter, parallel to the first surface and perpendicular to the flat annular surface, extending from an inner collar which is part of the inner wall of the container. These three surfaces are adapted to engage and mate with three corresponding surfaces of a connector, or of an appropriately designed valve, to provide fluid tight seals.

14 Claims, 4 Drawing Sheets

TRIPLE SEAL MOLDED OUTLET FOR PLASTIC STORAGE CONTAINER

FIELD OF INVENTION

This invention relates to molded outlets for plastic storage container and more particularly, to a triple seal molded outlet.

BACKGROUND OF THE INVENTION

Plastic containers, which are typically rotationally molded, injection molded or blow molded, usually require a connector at the container's outlet. The connection between the connector and the outlet must be sealed to prevent leakage. One common approach is to drill a hole through the side wall of the tank and attach a bulkhead fitting to the opening. The fitting includes inner and outer seal plates which engage the inner and outer walls around the opening. The bulkhead is secured by tightening the plates. A connector is then threaded into or onto the bulkhead fitting. It is difficult to maintain the seal between the fitting and the wall of the container, however. Since plastic flows in response to stress (cold flow), gaps can form around the bulkhead fitting, causing leakage. In addition, due to the space taken up by the plates, the outlet must be positioned above the bottom of the container, preventing complete drainage. The bulkhead can also be heavy, expensive, and difficult to attach. This increases the cost of the container as well as the number of containers rejected due to improper fitting.

In addition, bulkhead fittings sometimes require the use of an additional gasket to assist in tightening and sealing the plates. Such gaskets can be chemically incompatible with the contents of the container and can cause slippage when compressed.

Instead of a bulkhead fitting, an internally threaded outlet for receiving a connector can be formed in the container during the molding process. A connector, in the form of a short length of pipe having external threads, can then be screwed into the outlet. A valve with internal threads can be screwed onto the protruding end of the connector. The engagement between the threads of the connector and the threads of the outlet forms a better seal than does a bulkhead fitting, due to the increased sealing surface area. This seal, however, is still subject to leakage due to the natural cold flow of the plastic, stress fractures from use, high pressure or hard to seal fluids.

An improved molded outlet for plastic containers is needed to prevent leakage around connectors and valves simply and inexpensively.

SUMMARY OF THE INVENTION

According to the present invention, an improved molded outlet in a plastic container comprises a first cylindrical surface extending from the outer wall of the container partly through the wall, a flat annular surface essentially perpendicular to the first cylindrical surface lying within the wall and a second cylindrical surface essentially perpendicular to the annular surface and essentially parallel to the first cylindrical surface. The second cylindrical surface is part of an inner collar which extends from the inner wall of the container. The first and second cylindrical surfaces, and the flat annular surface provide 3 sealing surfaces for engagement with an connector. The first cylindrical surface is preferably threaded, and the second cylindrical surface may be threaded as well.

Also according to the present invention, a triple sealing outlet for a plastic container comprises a U-shaped channel with three sealing surfaces within a wall of the container for receiving a connector. The first sealing surface is in the shape of a cylinder extending from an outer wall of the container into the U-shaped channel and is threaded along its inner surface for engaging and sealing a threaded outer surface of a connector. The second sealing surface is perpendicular to the first and forms a sealing and mating surface against which a corresponding surface of the connector rests. The third sealing surface is parallel to the first and perpendicular to the second. It engages and seals an inner surface of the connector. The third sealing surface is part of an inner collar extending from an inner wall of the container. The collar defines an opening for allowing communication between the connector and the interior of the container.

Another embodiment of the invention is a combination plastic container and connector. The connector is generally cylindrical and has an outer threaded surface joined to an inner surface through a perpendicular surface, i.e., a section of externally threaded pipe. The container has an outlet with a first cylindrical threaded surface adapted to engage and seal the outer threaded surface of the connector. The outlet also has an annular surface integral with and perpendicular to the first cylindrical surface to engage and seal the perpendicular surface of the connector. The outlet has a second cylindrical surface parallel to the first cylindrical surface and perpendicular to the annular surface, to engage and seal a portion of the inner surface of the connector. The second cylindrical surface is part of an inner collar extending from an inner wall of the container, which defines an opening between the container and the interior of the connector, for removing fluid or flowable solids from the container. In use, a valve is connected to the connector.

DESCRIPTION OF THE INVENTION

Figure 1:
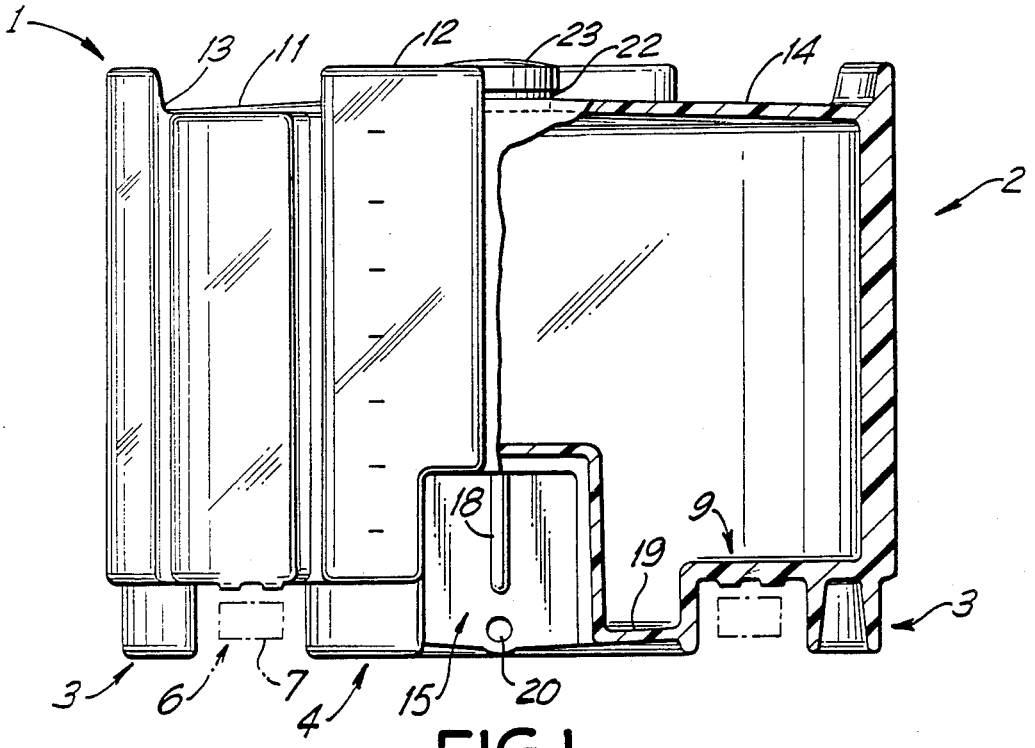
FIG. 1 is a front, partially cross-sectional view of a container utilizing the outlet of the present invention.

FIG. 1 shows a molded container 1 which utilizes the outlet 20 of the present invention. The container is formed by rotational molding. While the invention is described in relation to a rotationally molded container with certain preferred features, it can be used in any plastic container of any design, used to contain liquids or flowable solids. Plastic containers utilizing the present invention can, for example, be rotationally molded, injection molded or blow molded.

Figure 2:
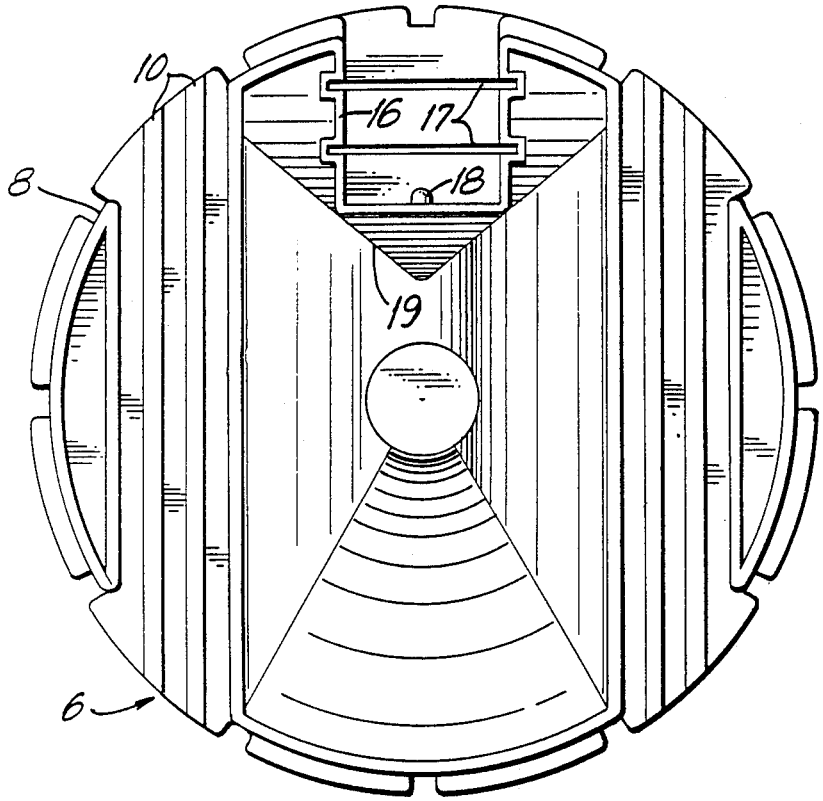
FIG. 2 is a bottom view of the container of FIG. 1.

As shown in FIGS. 1 and 2, the container 1 is comprised of a body 2, legs 3 and a base 4. The legs 3 and base 4 have the same height and provide horizontal support surfaces for positioning a filled container 1 on a flat surface. The base 4 lies between legs 3, which are on opposing sides of and project downwardly from the body portion 2. The space between the base 4 and the legs 3 form channels 6 adapted to receive forklift blades 7, shown in phantom. This configuration permits the easy movement of the storage tank by a hand or power operated forklift device.

In FIG. 2, the legs 3 are shown composed of generally arcuate shaped ridges 8, which extend from the bottom of body 2. This unique leg design can be formed during the manufacture of a onepiece tank by rotational molding by the insertion of generally arcuate shaped plugs in the mold. During the manufacture of storage tank 1, residue collects around and over the plugs, forming ridges 8. As shown in FIG. 1, the smooth interior bottom surface 9 of the body 2 spans the area between the top of the ridges 8, preventing the accumulation of stored material in legs 3, allowing for the complete drainage of the contents of the tank and its easy clean out.

As shown in FIG. 2, channel 6 is provided with a plurality of reinforcing ribs 10 for added wall thickness and enhanced rigidity and strength.

Returning to FIG. 1, the body 2 is shown with a plurality of columnar ribs 11 and 12 for reinforcement. The ribs 11 and 12 provide vertical support and resistance to radial impact and deformation of the structure. In the embodiment shown in FIG. 1, rib 12 has a height greater than that of the body 2 while rib 11 is of the same height as the body. Two ribs 12 are followed by one rib 11, providing an alternating pattern of vertically projecting ribs. The rounded intersections 13 between ribs 12 and the top 14 of tank 1, distribute forces due to impacts against the ribs 12 to the rest of the structure, avoiding fractures.

Figure 8:
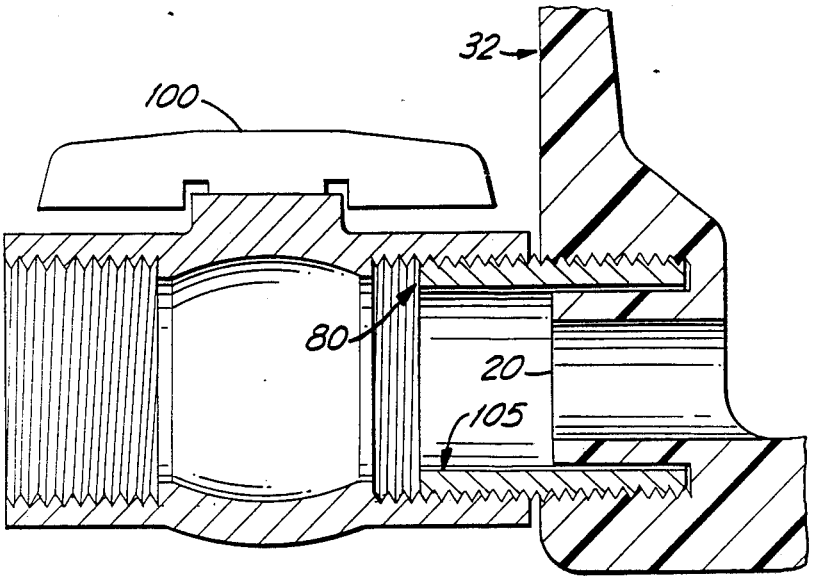
FIG. 8 is a cross-sectional view of the outlet and connector of FIG. 5, with a valve attached to the connector.
Figure 9:
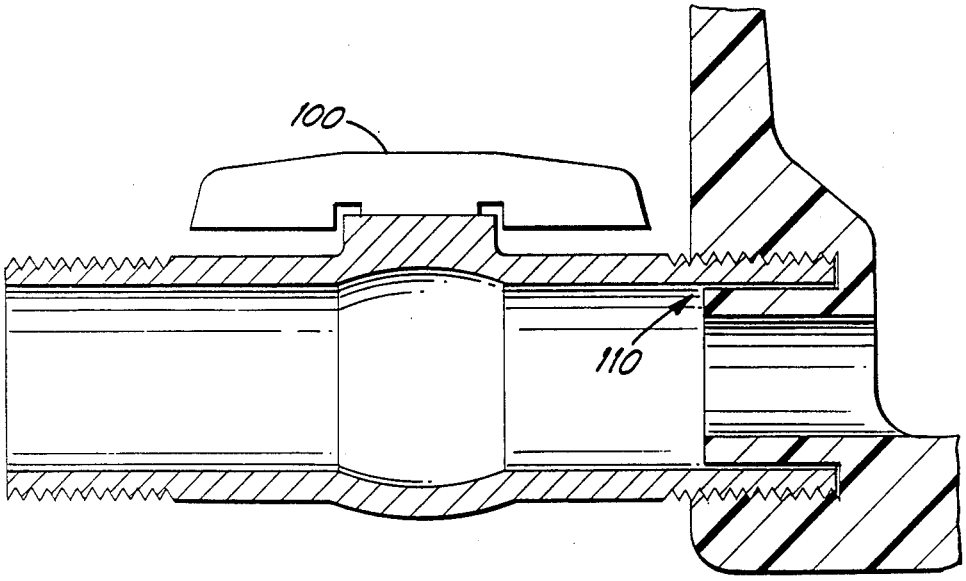
FIG. 9 is a cross-sectional view of a valve attached directly to the outlet of the present invention.

Outlet 20 is preferably located within a recessed region 15 of the body 2. The outlet of the present invention is discussed further below. As shown in FIG. 2, the interior surface 16 of the recessed region 15 has two internal ribs 17 and an external rib 18 for added strength. The inner surface 9 of the base 4 is generally convex and inclined toward outlet 20, as shown in FIG. 1, permitting the complete drainage of the storage tank 1. A discharge valve 100, as shown in FIGS. 8 and 9, and discussed further below, controls the discharge of liquid through outlet 20, and is protected from impact during handling by virtue of its position in the recess 15. While preferred, the outlet of the present invention need not be placed in such a recessed section.

The container can be filled through an inlet tube 22 in the top surface 14 of the container. A cap 23 seals the tube 22. The top surface 14 is preferably dome-shaped, allowing for the drainage of any fluids, such as rain, which could collect on the container. The intersection between the opening 23 and top surface 14 is rounded so that if the cap 23 or opening 22 sustains an impact, the force will be distributed over the top surface 14 to ribs 11 and 12, avoiding a possible fracture.

Figure 3:
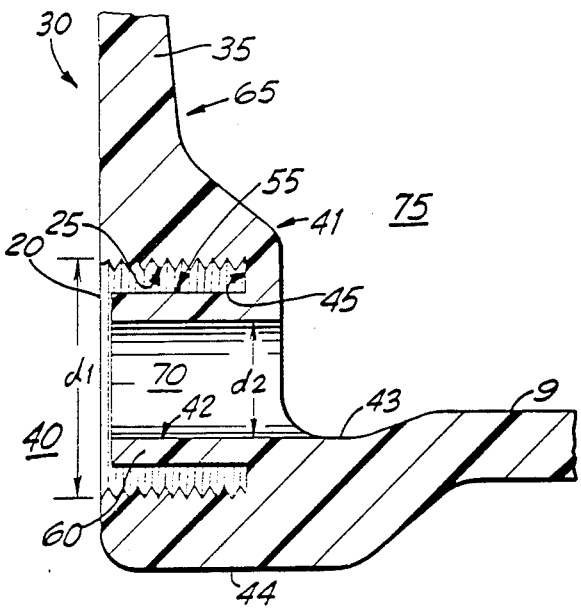
FIG. 3 is a cross-sectional view of the outlet of the present invention.
Figure 4:
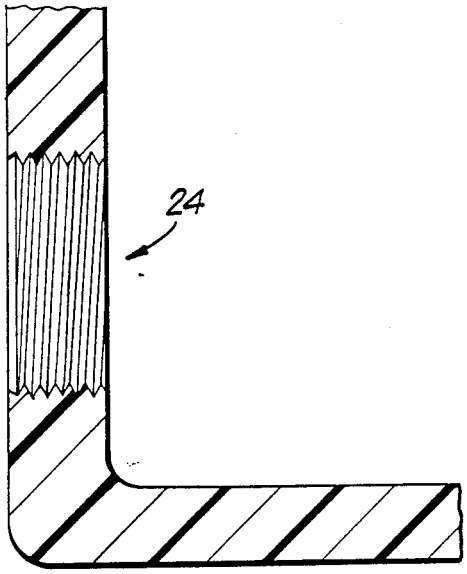
PRIOR ART FIG. 4
FIG. 4 is a cross-sectional view of a prior art outlet.

FIG. 3 shows a cross-sectional view of an outlet 20 in accordance with the present invention, as it can appear in a container of any configuration. FIG. 4 shows a prior art, threaded outlet 24. As shown in FIG. 3, the outlet of the present invention has a first cylindrical surface 25 extending from the outer wall 30 of the container 1, partially through the wall 35. The surface 30 defines a cylindrical opening 40 having a first diameter d1. A flat, annular surface 45 is essentially perpendicular to surface 45. A second cylindrical surface 55 is essentially perpendicular to surface 45 and is essentially parallel to surface 25. The surface 55 is part of an inner collar 60, which extends from the inner wall 65 of the container 1 partially through the wall 35. The inner collar 60 defines a second cylindrical opening 70 having a second diameter d2, which extends from the first opening 40, through the wall 35, to the interior 75 of the container. The first and second openings partly or completely overlap in the region 57 of the inner collar. In the preferred embodiment, the surface 25 of the outlet is threaded. The surface 55 may also be threaded for applications where even better sealing is required, as is discussed further below in relation to FIG. 7.

The portion 41 of the wall 35 is preferably thickened in the region of the outlet, in the sidewall adjacent the base of the container to give it adequate depth to form the first cylindrical surface 30. The outlet 20 is located at the base of the wall 35, so that the bottom 42 of the inner collar 60 coincides with the bottom 9 of the container. The bottom 9 of the container in the region of the outlet can have a region 43 inclined toward the outlet 20 to assure the complete drainage of the liquid in the container. The thickness of the bottom 44 of the container can also be increased in the region of the outlet for added support.

Figure 5:
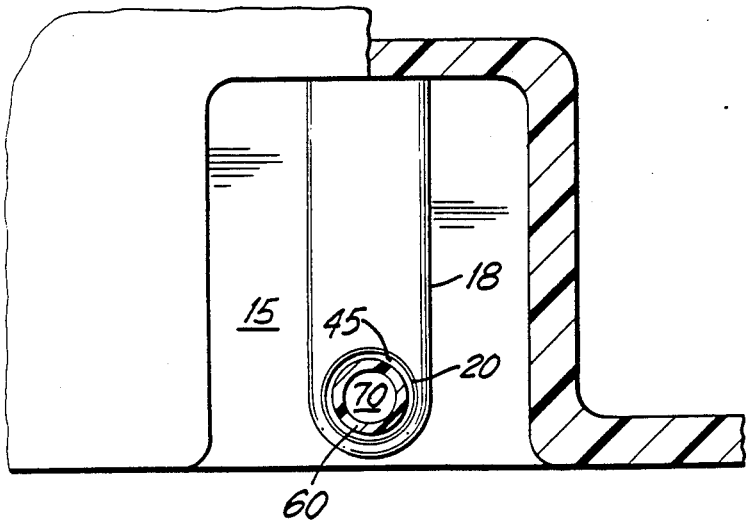
FIG. 5 is a front view of the outlet of the present invention located in a recessed region of the tank of FIG. 1.
Figure 6:
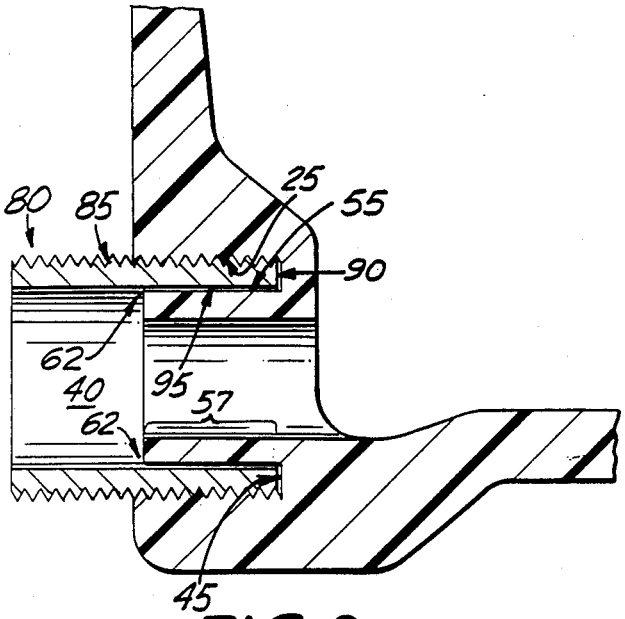
FIG. 6 is a cross-sectional view of the outlet shown in FIG. 3, into which a connector has been threaded.

In use, a connector 80, which is a short section of threaded pipe commonly referred to as a nipple, having an outer threaded surface 85, is screwed into opening 40, with the outer threaded surface 85 engaging the threaded surface 25, as shown in FIG. 5. The three surfaces 25, 45 and 55 form a U-shaped channel 62. The nipple 80 is inserted until the annular surface 90 at the end of the nipple engages and is stopped by the surface 45. The inner surface 95 of nipple 80 engages the second cylindrical surface 55 of the outlet 20. The three surfaces 25, 45 and 55, thus engage the corresponding surfaces 85, 90 and 95 of the nipple, forming a leakproof seal superior to that of prior art threaded outlets which only provide a single sealing surface, as shown in FIG. 4.

The second cylindrical surface 55 can have any length. The greater its length, the greater the sealing surface area and the better seal. Therefore, a length approaching or essentially equal to the length of the first cylindrical surface 25 is preferred. The thickness of the nipple should be about 8% to 10% greater than the width of the annular U-shaped channel 62 to ensure a tight seal. For example, if the height of the channel is 0.115 inches, the thickness of the nipple should be about 0.125 inches. The width of the channel generally corresponds to the thickness of the perpendicular surface 45. The nipple can be further secured to the outlet with solvent cement, such as tetrahydrofluorane or other standard sealing compounds. Such sealing compounds can also be used if the surface 25 is not threaded.

The nipple can be plastic or metal. Plastic nipples are preferred if acidic, basic or inorganic chemicals are being stored, since such chemicals can react with and corrode metal. A valve 100 can be rotated onto the section 105 of the nipple 80, which extends out of the outlet 20, beyond outer wall 35 as shown in FIG. 8. In another embodiment, a valve having an integral, externally threaded portion 110 which corresponds to the connector and which can be screwed directly into the outlet can be employed, thereby eliminating the need for a separate connector or nipple, as shown in FIG. 9. It is also possible that the first cylindrical surface 25 of the outlet be smooth, for accommodating a connector of, for example, polyvinylchloride (PVC). In this case, the nipple is cemented to the outlet with solvent cement, as is known in the art.

The three sealing surfaces provide increased sealing surface area between the parts, and therefore greater assurance against leakage than outlets in the prior art. Threading increases the sealing surface area even more. A liquid must by pass each of the three sealing surfaces 25, 45 and 55, to escape around the nipple 80. If plastic should separate from the first sealing surface 25 due to cold flow, for example, the other sealing surfaces will still provide adequate protection against leakage. In addition, the three sealing surfaces give increased support to the nipple 80 and valve 19. This gives the outlet, nipple and valve greater strength against mechanical stress which could deform the outlet or loosen the nipple than the means employed by the prior art. Even if some deformation or cracking of the outlet occurs, the triple seal will prevent or substantially reduce leakage. The exposure of the nipple to corrosive chemicals could also cause leakage, which is similarly resisted by the triple sealing outlet.

Figure 7:
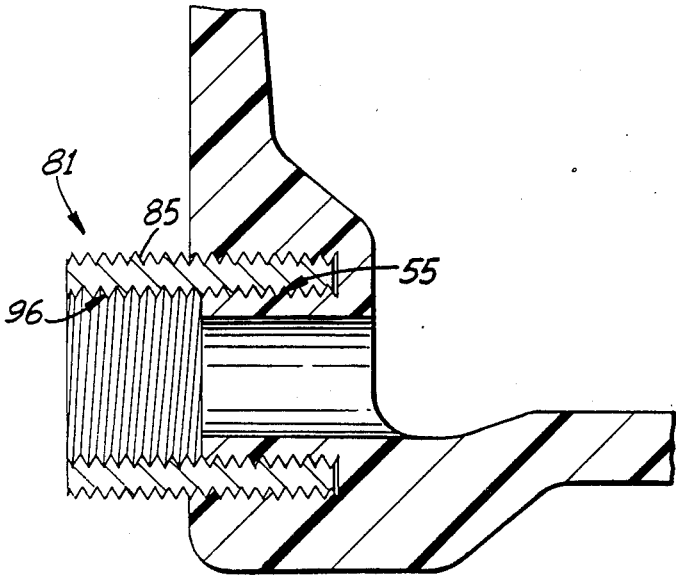
FIG. 7 is a cross-sectional view of the outlet of the present invention with a threaded second cylindrical surface engaging a connector.

As stated above, the second cylindrical surface 55, and the corresponding surface on the connector can also be threaded for even greater sealing. A connector 81 with a threaded inner surface 96 is shown in FIG. 7. This is preferred if the container is to be pressurized, for example, which can put added stress on the outlet. Pressurization is often used with containers holding corrosive chemicals, such as sulfuric and nitric acid. The pumps which are typically used to draw stored liquids through the valve, connector and outlet, can be degraded by the chemicals. Instead of using the pumps, the container can be pressurized to between 60–100 psi through the opening 23. The air pressure forces the liquid out of the container when the valve 100 is opened.

In a preferred method for forming the outlet in a plastic container, a plug in the shape of the outlet is placed in a mold. The plug is removed from the mold before the finished tank is removed. The threaded surface 25 can be formed by either threading the exterior of the plug or with a machine tool, such as a tapping tool, in a manner known in the art, after the formation of the container.

I claim:

1. A plastic container having an outlet comprising;

a first cylindrical surface extending from an outer surface of a wall of said container partly through said wall, said cylindrical surface defining a first cylindrical opening with a first diameter;

a flat annular surface within said wall integral with and essentially perpendicular to the first cylindrical surface;

a second cylindrical surface integral with and essentially perpendicular to the flat annular surface, and essentially parallel to the first cylindrical surface;

the second cylindrical surface being part of an inner collar extending from an inner surface of the container, the inner collar defining a second cylindrical opening having a second diameter less than the first diameter, the second cylindrical opening overlapping the first opening and extending into the container.

2. The container of claim 1, wherein the first cylindrical surface is threaded.

3. The container of claims 1 or 2, wherein the second cylindrical surface has a length essentially equal to the length of the first cylindrical surface.

4. The container of claim 3, wherein the inner collar has a bottom surface that coincides with the adjacent bottom surface of the container.

5. The container of claim 4, wherein the bottom surface of the container is inclined toward the inner collar.

6. The container of claim 1, wherein the thickness of the wall is greater in the region of the outlet.

7. The container of claim 6, wherein the thickness of the bottom of the tank is greater in the region of the outlet.

8. The container of claim 2, wherein the second cylindrical surface is threaded.

9. The container of claim 1, wherein the container is rotationally molded, injected molded or blow molded.

10. A triple sealing outlet for a plastic container comprising an annular U-shaped channel positioned within a wall of the container for receiving a connector;

the U-shaped channel comprising first, second and third sealing surfaces;

the first sealing surface in the shape of an inner surface of a cylinder, extending from the outer wall of the container into the U-shaped channel, the inner surface defining a first cylindrical opening and being threaded for engaging and sealing a threaded outer surface;

the second surface being essentially annular and essentially perpendicular to the first sealing surface, the second surface forming a stop for, and adapted to mate with a side surface of the connector for sealing the side surface;

the third sealing surface being essentially parallel to the first sealing surface and essentially perpendicular to the second sealing surface, for engaging and sealing an inner surface of the connector;

the third sealing surface being part of an inner collar extending from an inner wall of the container, the collar defining a second cylindrical opening for allowing communication between the connector and the interior of the container.

11. The outlet of claim 10, wherein the third sealing surface has a length essentially equal to the length of the first sealing surface.

12. The outlet of claim 10, wherein the thickness of the wall is greater in the region of the outlet.

13. The outlet of claim 12, wherein a valve is connected to the outlet.

14. The outlet of claim 12, wherein the third sealing surface is threaded.

* * * * *